US007219975B2

(12) United States Patent
Makita

(10) Patent No.: US 7,219,975 B2
(45) Date of Patent: May 22, 2007

(54) INK-JET HEAD

(75) Inventor: Masahiro Makita, Tachikawa (JP)

(73) Assignee: Konica Minolta Holdings, Inc. (JP)

( * ) Notice: Subject to any disclaimer, the term of this patent is extended or adjusted under 35 U.S.C. 154(b) by 313 days.

(21) Appl. No.: 10/943,058

(22) Filed: Sep. 16, 2004

(65) Prior Publication Data

US 2005/0062786 A1 Mar. 24, 2005

(30) Foreign Application Priority Data

Sep. 22, 2003 (JP) ..... 2003-330784

(51) Int. Cl.
*B41J 2/015* (2006.01)
*B41J 2/05* (2006.01)
*B41J 2/145* (2006.01)

(52) U.S. Cl. ..... 347/20; 347/67; 347/40

(58) Field of Classification Search ..... 347/20, 347/33, 40, 11, 45, 47, 48, 71, 21, 44, 64
See application file for complete search history.

(56) References Cited

FOREIGN PATENT DOCUMENTS

JP 2000-141652 5/2000
JP 3127573 11/2000
JP 2001-150668 6/2001

OTHER PUBLICATIONS

English Abstract for JP 05-330041 corresponds to JP3127573.
English Abstract for JP 2000-141652.
English Abstract for JP 2001-150668.

*Primary Examiner*—Shih-wen Hsieh
(74) *Attorney, Agent, or Firm*—Cantor Colburn LLP

(57) ABSTRACT

An ink-jet head to jet ink from a front side thereof includes an actuator in which a plurality of parallel channels for generating pressure change to be applied to ink are formed and having a nozzle surface on which a plurality of nozzle holes are formed to jet ink from a corresponding ink channel, and a front plate located at the front side of the nozzle surface so as to protect the nozzle surface and having a recessed section on a front surface of the front plate, wherein the recessed section has an opening in which the nozzle surface of the actuator is inserted in such a way that the nozzle surface is located between the front surface of the front plate and the bottom surface of the recessed section.

7 Claims, 3 Drawing Sheets

INK-JET HEAD

FIELD OF THE INVENTION

The present invention relates to an ink-jet head for recording a desired image by jetting ink from nozzles onto a recording medium, wherein a front plate of the ink-jet head is improved. The front plate is applied to the surface of a nozzle plate to serve as a flat plate for protection of the nozzle surface, prevention of peeling of the nozzle plate, and providing a plane to have tight contact with a suction cap for sucking ink from the nozzles.

BACKGROUND OF THE INVENTION

An ink-jet head for recording a desired image by jetting ink from nozzles onto a recording medium is maintained, to be able to jet ink in a normal state all the time, in such a manner that: ink is periodically and forcibly subjected to suction from nozzles; thus high viscosity ink accumulated in nozzles is exhausted; and thereby blockage in nozzles is resolved.

To suck ink as described above, it is necessary to cause a suction cap to tightly contact with the nozzle surface of the ink-jet head. However, the nozzle plate of an ink-jet head is extremely small, and even a nozzle plate having several hundreds of nozzles has dimensions, for example, 1 cm multiplied by several cm, or the like. Accordingly, when ink is sucked from nozzles, there are problems in that the nozzles cannot be covered with a suction cap enough, that, even when the nozzles are covered with the suction cap, the suction cap does not contact with the nozzles tight enough to ensure airtight, and so on. Further, although the nozzle plate is bonded to the front end of an actuator, the gap between the nozzle plate and the recording medium is so small as approximately 1 mm. Therefore, if the recording medium has come in contact with the ink-jet-head, a paper jam may occur on the recording medium and a large force may be applied to the head, which peels the nozzle plate off the actuator. Therefore, with respect to an ink-jet head, enclosing the periphery of a nozzle plate by a front plate is carried out to prevent these problems.

Thus, an ink-jet head is arranged in such a way that a nozzle surface is located in an opening of a front plate formed in a flat plate shape having the opening. By this front plate, the surface of a nozzle plate is protected; peeling of the nozzle plate is protected; and a space large enough to allow tight contact of a suction cap with the nozzle plate is formed.

However, if the front plate encloses the nozzle plate, ink gathers at the joint edge between the nozzle plate and the front plate. In this situation, although ink on the nozzle surface of the ink-jet head can be removed by wiping with a blade, the nozzle surface is desirably arranged at a position, in the opening of the front plate, deeper than the position of the surface of the front plate in order to prevent damage of nozzles due to, for example, rubbing with the recording medium. However, if nozzle surface 100*a* is arranged in a deeper position (the lower side in the figure) in opening 111 than surface 110*a* of front plate 110, ink 200 and dust easily gather at the joint edge between nozzle plate 100 and the front plate 110. Accordingly, wiping of the nozzle surface 100*a* cannot be performed effectively. Further, if the ink 200 having gathered here touches with a nozzle 101, problems such as disturbance of ink jetting and the like occur.

On the other hand, as shown in FIG. 6, if the nozzle surface 100*a* is arranged protruding from the surface 110*a* of the front plate 110, even when ink 200 or dusts gather at the joint edge between the nozzle plate 100 and the front plate 110, since the ink 200 or the dusts do not come in contact with the nozzle 101, ink jetting cannot be disturbed. However, since the nozzle surface 100*a* is protruding from the surface 110*a* of the front plate 110, the nozzle surface 100*a* cannot be protected, which causes problems of scratching the water repellent surface and peeling the nozzle plate 100.

For example, Patent Document 1, described later, discloses a technology in which a head cap for protection of a nozzle plate is arranged enclosing the nozzle plate, the nozzle surface is positioned 2 to 20 μm deeper than the surface of the head cap so that a blade and a recording medium do not come in hard contact with the nozzle surface, and thus a water repellent film coated on the nozzle surface can be prevented from peeling.

Further, Patent Document 2, described later, discloses a technology in which a nozzle plate cover is arranged around the periphery of a nozzle plate, the nozzle surface is positioned protruding toward a recording medium from the nozzle plate cover by the height not greater than the thickness of the plate, and thus the nozzle plate is prevented from peeling.

Still further, Patent Document 3, described later, discloses a technology in which, as shown in FIG. 7, in the state that nozzle surface 100*a* is protruded from surface 110*a* of front plate 110, adhesive 300 is applied to the edge space therebetween, then, an actuator is drawn back to move the nozzle surface 100*a* to a deeper position than the surface 110*a* of the front plate 110, and in this state, the adhesive 300 is cured. Thus, the step generated between the nozzle surface 100*a* and opening 111 of the front plate 110 is smoothed by the adhesive 300 to reduce ink that remains after cleaning by a blade.

(Patent Document 1) TOKKAI No. 2000-141652

(Patent Document 2) TOKKAI No. 2001-150668

(Patent Document 3) Patent No. 3127573

In the technology disclosed in Patent Document 1, as the nozzle surface is drawn to a position a little deeper than the surface of the front plate, the nozzle surface is protected. However, as a step is generated between the nozzle surface and the surface of the front plate, when removing ink adhering to the nozzle surface by wiping, ink tends to gather in the step, which may cause ink jetting failure due to the contact of the gathering ink with nozzles.

In the technology disclosed in Patent Document 2, although ink does not gather on the nozzle surface since the nozzle surface is protruded a little from the surface of the front plate, the nozzle surface cannot be protected enough.

In the technology disclosed in Patent Document 3, there is a problem that adhesive tends to flow into nozzles. To prevent this flow in of the adhesive, painstaking mask treatment is required, and further, to stably form the shape of the adhesive, it is necessary to finely control the relative position between the nozzle surface and the front plate after applying the adhesive, according to various conditions including the characteristics of the adhesive, the environmental temperature, and the dimensions of the gap between the nozzle surface and the opening of the front plate, which causes a problem of extreme difficulty in control of the adhesive and the shape thereof.

The defect common to the above technologies is that it is impossible to prevent ink from gathering at the joint edge between an actuator and a front plate, because an opening having a rectangular cross-section with dimensions which the actuator just fits in is formed through the front plate, and the actuator is inserted in the opening.

SUMMARY OF THE INVENTION

An object of the present invention is to provide an ink-jet head, with a simple structure, that solves the conflict between-requirement for protection of a nozzle surface and prevention of peeling of the nozzle plate, and requirement for maintainability of the nozzle surface.

To solve the problems described above, in the first aspect of the invention, there is provided an ink-jet head comprising: a plurality of parallel channels for generating pressure change to be applied to ink, an actuator provided with a number of disposed nozzles for jetting ink in each channel to a nozzle surface, and a front plate having an opening that encloses the nozzle surface, wherein a recessed section is provided on the surface of the front plate; the opening is formed in the central part of the bottom of the recessed section; further, the actuator is inserted in the opening; and the position of the nozzle surface is on the bottom side of the recessed section with respect to the surface of the front plate and on the front plate surface side of the recessed section with respect to the bottom of the recessed section.

According to the invention, since the position of the nozzle surface is on the bottom side of the recessed section with respect to the surface of the front plate, a recording medium or a blade does not come in hard contact with the nozzle surface. Therefore, a water repellent film cannot be scratched easily, and peeling of the nozzle plate can be prevented.

Further, as the location of the nozzle surface is on the front plate surface side of the recessed section with respect to the bottom of the recessed section, even if ink gathers on the step at the joint edge between the actuator and the front plate, ink is prevented from flowing into nozzles.

Still further, as the blade enters the opening, ink adhering to the nozzle surface can be easily wiped.

DETAILED DESCRIPTION OF THE PREFERRED EMBODIMENT

Figure 1:
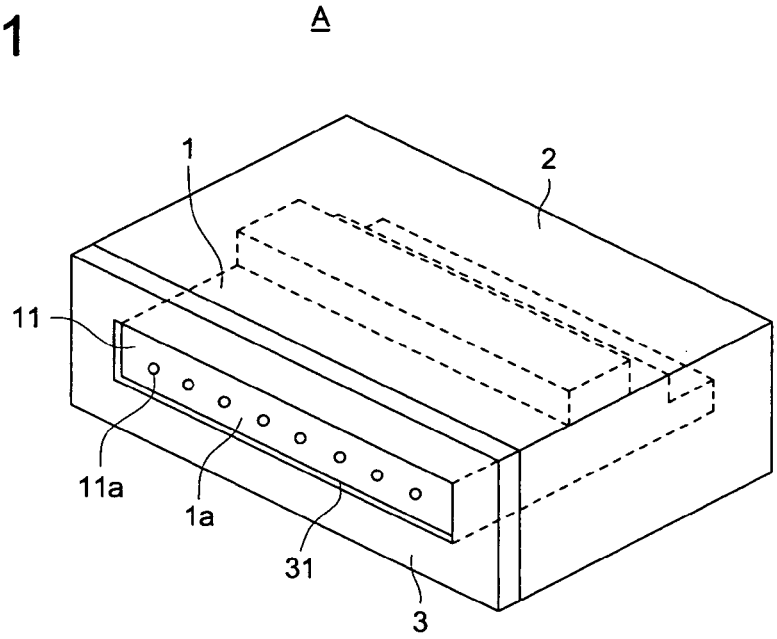
FIG. 1 is an external isometric view of an ink-jet head in accordance with the present invention.
Figure 2:
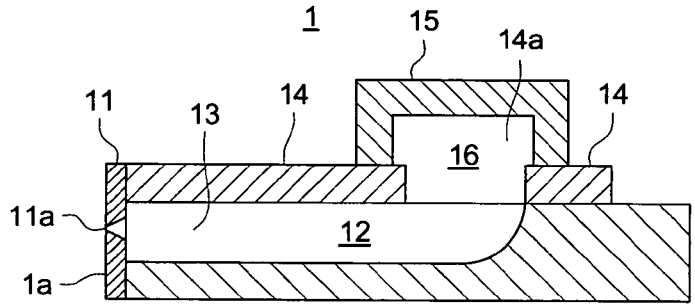
FIG. 2 is a cross-sectional view principally showing a schematic structure of an actuator.

FIG. 1 is an external isometric view of an ink-jet head in accordance with the present invention, and FIG. 2 is a cross-sectional view principally showing the schematic structure of an actuator.

In FIG. 1, symbol A denotes the ink-jet head, and numeral 1 denotes the actuator. On the front face of the actuator 1, nozzle plate 11 provided with a number of disposed nozzles 11*a* for jetting ink is adhered. The actuator 1 comprises a non-piezoelectric ceramic substrate having a longitudinal shape and a number of parallel channels corresponding to the respective nozzles 11*a*, and a ceramic member that is arranged on the non-piezoelectric ceramic substrate and provided with piezoelectric ceramic layers having opposite polarization directions. The actuator 1 generates pressure change to be applied to ink.

Each channel 12 is formed by cutting the non-piezoelectric ceramic in a linear thin channel shape by a diamond blade or the like, wherein the remaining non-piezoelectric ceramic forms isolation walls 13 between respective channels 12, 12 neighboring to each other. The depth of each channel 12 gradually becomes smaller as it comes closer to the right end in the figure, and finally becomes zero. On a part of the surface of each channel 12, a metal electrode (not shown) is formed.

Further, from above the channels 12, a cover substrate 14 of a non-piezoelectric ceramic substrate, or the like, is adhered. Through the cover substrate 14, opening 14*a* led to all the channels 12 is formed at the position corresponding to the shallow portions of the channels 12. To cover the opening 14*a*, manifold 15 is arranged, and thus, shared ink chamber 16 is formed between the inner surface of the manifold 15 and the shallow portions of the respective channels 12 to distribute ink to the respective channels 12.

As the material of the non-piezoelectric ceramic substrate, at least one of aluminum, aluminum nitride, zirconia, silicon, silicon nitride, silicon carbide, crystal is preferably employed so that polarized piezoelectric ceramic is securely supported even if the isolation walls 13 are subjected to shear-deformation.

As the material of the piezoelectric ceramic, ceramic, such as PZT or PLZT, which is a mixed crystallite mainly of PbOx, ZrOx, TiOx, containing a trace amount of a metallic oxide known as a softening agent or a hardening agent, such as Nb, Mg, Sn, Ni, La, Cr, etc. is preferably employed.

PZT is lead titanate zirconate having a large filling density, a large piezoelectric constant, and an excellent processability. Therefore, PZT is a preferable material. If the temperature of PZT is dropped after burning, the crystallographic structure suddenly changes, atoms are deviated, and the PZT turns into an aggregate of minute crystals in a form of a dipole of which one side is positive and the other side is negative. Such a spontaneous polarization has random direction, cancels the polarities to each other, and therefore needs further polarization treatment.

In polarization treatment, a thin plate of PZT is sandwiched by electrodes, immersed into silicon oil, subjected to a high electric field of approximately 10 to 35 kv/cm, and thus polarized. When a voltage is applied to the polarized PZT orthogonally to the polarization direction, the side walls are shear-deformed into a dogleg shape in an oblique direction due to piezoelectric effect, and thus the volume of the ink chamber expands.

As the material of the metallic electrodes, gold, silver, aluminum, palladium, nickel, tantalum, or titanium can be employed, and particularly, gold and aluminum are preferable due to electric characteristics and processability, wherein the electrodes are formed by plating, vapor deposition, and sputtering. Each metallic electrode is drawn out from inside each channel 12, through a shallow recessed section portion, up to the top face on the rear side (right end in FIG. 2) of the actuator 1, and electrically connected by a signal cable (not shown) with a drive circuit.

The nozzle plate 11 is formed of plastic such as, polyalkylene terephthalate, polyimide, polyetherimide, polyetherketone, polyethersulfone, polycarbonate, cellulose acetate, etc., and the surface of the this nozzle plate 11 (the surface on the side where ink is jetted from nozzles 11*a*) is the nozzle surface 1*a*.

With respect to the actuator 1 arranged as above, when a drive voltage given by a drive circuit is applied to the electrodes in the respective channels 12, the isolation walls 13 are shear-deformed to generate a pressure change in the channels 12, and then ink, in the channels 12, subjected to a pressure is jetted from the nozzles 11*a*. The ink having been jetted flies forward in the longitudinal direction of the channels 12 and impacts a recording medium such as paper.

As shown in FIG. 1, the actuator 1 is housed in housing 2, and with respect to the housing 2, the front plate 3 is provided on the same side as the nozzle surface 1*a* of the actuator 1.

The front plate 3 is made of, for example, acryl, polycarbonate, polyetherimide, modified PPE, aluminum, stainless steel, etc., and almost in the central part of the front plate 3, opening 31 almost in the same shape as the nozzle surface 1*a* of the actuator 1 is provided. The actuator 1 is inserted in the opening 31 so that the nozzle surface 1*a* of the actuator 1 is positioned to face outside from the opening 31.

Therefore, with respect to this ink-jet head A, a wide flat plate shaped space is formed by the front plate 3 around the nozzle surface 1*a* of the actuator 1. When ink is forcibly sucked from the nozzles 11*a* of the actuator 1 by the use of a suction cap (not shown), the ink can be sucked by having the suction cap tightly contact with the surface 3*a* of the front plate 3, wherein the suction cap covers the nozzle surface 1*a* of the actuator 1.

Figure 3:
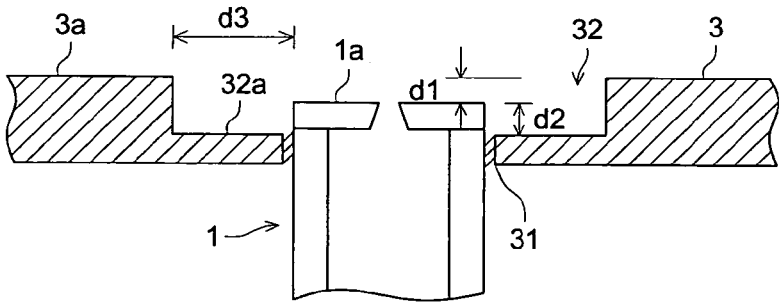
FIG. 3 is a cross-sectional view showing a relationship between a nozzle surface of the actuator and an opening of a front plate.

Further, the nozzle surface 1*a* of the actuator 1 and the opening 31 of the front plate 3 are shown in FIG. 3 in detail.

As shown in the figure, the front plate 3 is greater than the nozzle surface 1*a* of the actuator 1, and formed with recessed section 32 hollowed from the surface 3*a* of the front plate 3. In the central part of the recessed section 32, the above opening 31 is formed.

In the opening 31 of the front plate 3, the position of the nozzle surface 1*a* of the actuator 1 is located on the bottom 32*a* side of the recessed section 32, which is on the deep side (lower side in FIG. 3), with respect to the surface 3*a* of the front plate 3, and on the front plate surface 3*a* side (upper side in FIG. 3) of the recessed section 32 with respect to the bottom 32*a* of the recessed section 32. Therefore, the surface 3*a* of the front plate 3 is stepped to the deep side from the nozzle surface 1*a* only in the periphery of the nozzle surface 1*a*, wherein the actuator 1 is adhered to the opening 31 of the front plate 3 by the use of adhesive.

As described above, since the nozzle surface 1*a* is stepped deeper than the surface 3*a* of the front plate 3, even when a recording medium comes into contact with the front plate 3, it does not come into direct contact with the nozzle surface 1*a*. Therefore, a water repellent film coated on the nozzle surface 1*a* is prevented from damage, and the nozzle plate 11 cannot be peeled.

Further, in performing maintenance work, even when ink remaining after winding by a blade gathers in the bottom 32*a* of the recessed section 32 of the front plate 3, as the nozzle surface 1*a* is protruding from the bottom 32*a* of the recessed section 32 toward the surface 3*a* of the front plate 3, this ink does not come in contact with the nozzle surface 1*a*, and accordingly, the ink does not come in contact with nozzles, avoiding prevention of ink jetting.

Further, as the step of the recessed section 32 has room to let a blade enter during wiping, ink having gathered here can be easily wiped and removed.

As shown in FIG. 3, representing the distance between the surface 3*a* of the front plate 3 and the nozzle surface 1*a* of the actuator 1 by d1, the distance between the nozzle surface 1*a* of the actuator 1 and the bottom 32*a* of the recessed section 32 by d2, and the width of the bottom 32*a* of the recessed section 32 by d3, the above described d1 is preferably set in the range $0<d1 \leqq (d3)/2$. If d1 is greater than (d3)/2, the depth from the surface 3*a* of the front plate 3 is too large, and it is difficult for the tip end of a blade to reach the nozzle surface 1*a* in winding the nozzle surface 1*a* by the blade. Thus, the problems of unevenness of wiping and remains after wiping are caused, degrading the maintainability.

Further, the above d2 is preferably set in the range $0<d2 \leqq 0.5$ mm. If d2 is greater than 0.5 mm, the amount of remaining ink in the recessed section 32 becomes too large when performing suction of ink, and also, it becomes difficult to wipe the remaining ink by a blade.

Still further, the above d3 is preferably set in the range $0.1<d3 \leqq 2$ mm. If d3 is smaller than 0.1 mm, when wiping the nozzle surface 1*a* by the blade, it is difficult for the tip end of the blade to reach the nozzle surface 1*a*, causing unevenness of wiping and remains after wiping to degrade maintainability, and also, if ink or dust remains between an edge of the nozzle surface 1*a* and the recessed section 32 after having performed wiping the nozzle surface 1*a* by the blade, it is difficult to keep the ink or the dust in the recessed section 32, thereby causing the possibility of contaminating again the nozzle surface 1*a*. On the other hand, if d3 is larger than 2 mm, the protection function by the surface 3*a* of the front plate 3 degrades, and it is possible that, when a recording medium moves up, the recording medium rubs the nozzle surface 1*a*. Further, the head suction cap becomes larger.

When d1, d2, and d3 respectively satisfy the above ranges, protection of the nozzle surface 1*a* by the surface 3*a* of the front plate 3, prevention of peeling of the nozzle plate 11, and maintainability in wiping the nozzle surface 1*a* by the blade, can be best satisfied. More preferably, d1, d2, and d3 are set in the respective ranges $0.05 \text{ mm} \leqq d1 \leqq (d3)/3$ for d1, $0.05 \text{ mm} \leqq d2 \leqq 0.2$ mm for d2, and $0.2 \text{ mm} \leqq d3 \leqq 1$ mm for d3.

As a method for forming the recessed section 32, as stated above, in the periphery of the opening 31 of the front plate 3, processing of forming a resin die, aluminum die cast processing, and metal press processing can be employed, according to the material. In this way, as the recessed section 32 can be formed by mechanical processing on the front plate 3, it is allowed to form the recessed section 32 into a stable shape and with easiness.

Figure 4:
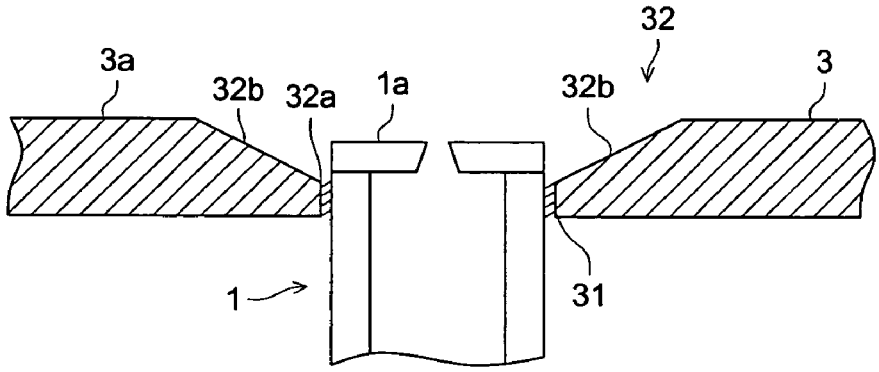
FIG. 4 is a cross-sectional view showing another embodiment of the relationship between a nozzle surface of an actuator and an opening of a front plate.
Figure 5:
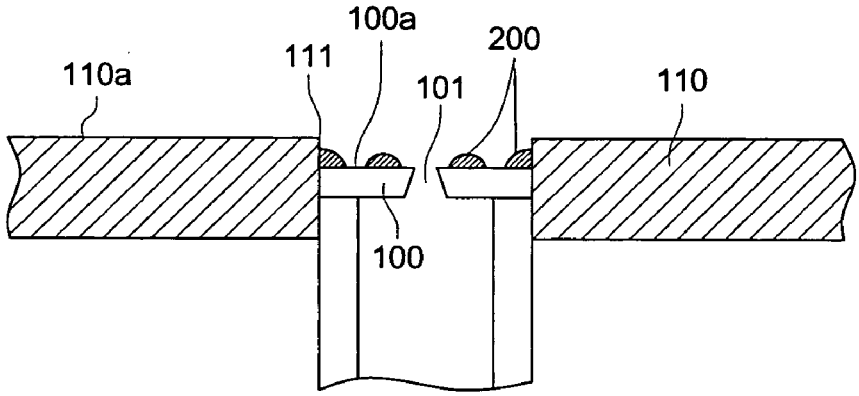
FIG. 5 is a diagram explaining a conventional relationship between a nozzle surface of an actuator and an opening of a front plate.
Figure 6:
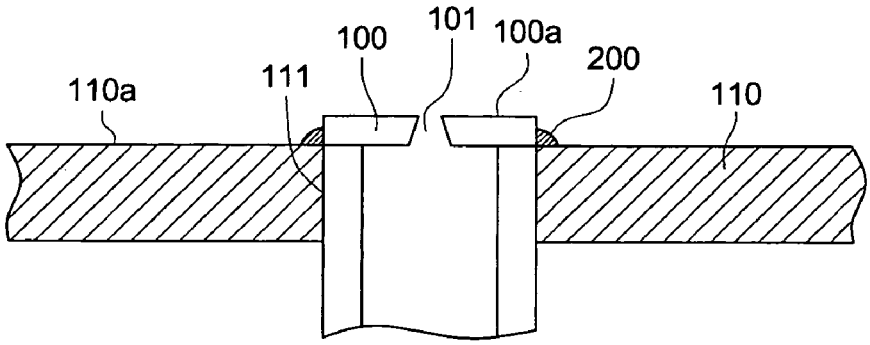
FIG. 6 is a diagram explaining another conventional relationship between a nozzle surface of an actuator and an opening of a front plate.
Figure 7:
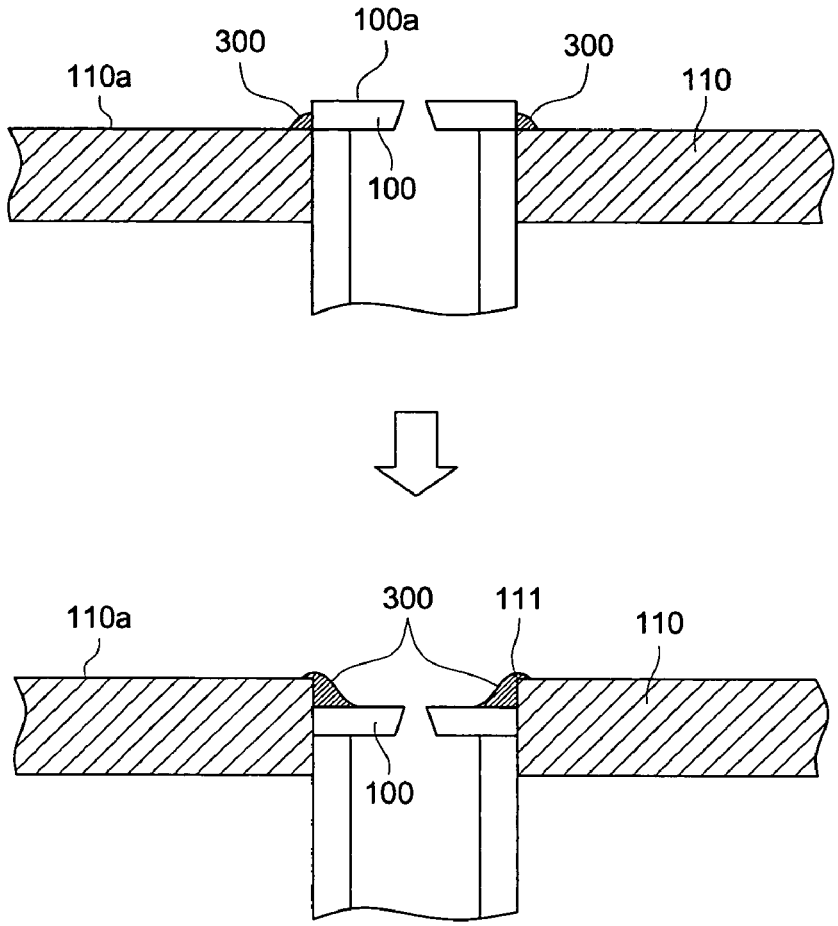
FIG. 7 is a diagram explaining a manufacturing method of a conventional ink-jet head.

Although, in FIG. 3, the shape of the bottom 32*a* of the recessed section 32 forms a plane which is almost parallel to the surface 3*a* of the front plate 3 and the nozzle surface 1*a* of the actuator 1, there is no limitation to this. The cross-section of the bottom 32*a* of the recessed section 32 may be a concave shape hollowing into the deep side (lower side in FIG. 3) in an arc shape, or as shown in FIG. 4, it is also allowed to form slope surface 32*b* by which the inner peripheral edge of the opening 31 of the front plate 3 and the outer peripheral edge (boundary with the surface 3*a*) of the recessed section 32 are smoothly and continuously connected.

What is claimed is:

1. An ink-jet head to jet ink from a front side thereof, comprising:

an actuator in which a plurality of parallel channels for generating pressure change to be applied to ink are formed, having a nozzle surface through which a plurality of nozzle holes are formed to jet ink from a corresponding ink channel; and a front plate located at the front side of the nozzle surface so as to protect the nozzle surface, having a recessed section on a front surface thereof, wherein the recessed section has an opening in which the nozzle surface of the actuator is inserted, and a slope surface which smoothly and continuously connects an inner peripheral edge of the opening of the recessed section and an outer peripheral edge of the recessed section;

and wherein the nozzle surface is located between the front surface of the front plate and a bottom of the slope surface.

2. The ink-jet head of claim 1, wherein a water repellent film is coated both on the nozzle surface and the slope surface of the recessed section.

3. An ink-jet head to jet ink from a front side thereof, comprising:

an actuator in which a plurality of parallel channels for generating pressure change to be applied to ink are formed, having a nozzle surface through which a plurality of nozzle holes are formed to jet ink from a corresponding ink channel; and a front plate located at the front side of the nozzle surface so as to protect the nozzle surface, having a recessed section on a front surface thereof, wherein the recessed section has an opening in which the nozzle surface of the actuator is inserted in such a way that the nozzle surface is located between the front surface of the front plate and the bottom surface of the recessed section;

wherein a water repellent film is coated both on the nozzle surface and the bottom surface of the recessed section.

4. The ink-jet head of claim 3, wherein the following formula is satisfied:

$$0\ \text{mm} < d1 \leqq (d3)/2$$

where d1 represents a distance between the front surface of the front plate and the nozzle surface and d3 represents a distance between a side of the recessed section and a side of the nozzle surface.

5. The ink-jet head of claim 3, wherein the following formula is satisfied:

$$0 < d2 \leqq 0.5\ \text{mm}$$

where d2 represents a distance between the nozzle surface and the bottom surface of the recessed section.

6. The ink-jet head of claim 3, wherein the following formula is satisfied:

$$0.1 \leqq d3 \leqq 2\ \text{mm}$$

where d3 represents a distance between a side of the recessed section and a side of the nozzle surface.

7. The ink-jet head of claim 3, wherein the following formulas are satisfied:

$$0.05\ \text{mm} \leqq d1 \leqq (d3)/3;$$

$$0.05 \leqq d2 \leqq 0.2\ \text{mm}\ ;\ \text{and}$$

$$0.2 \leqq d3 \leqq 1\ \text{mm}$$

where d1 represents a distance between the front surface of the front plate and the nozzle surface;

d2 represents a distance between the nozzle surface and the boftom surface of the recessed section; and d3 represents a distance between a side of the recessed section and a side of the nozzle surface.

* * * * *